United States Patent [19]

Braxmeier et al.

[11] Patent Number: 4,997,291

[45] Date of Patent: Mar. 5, 1991

[54] BEARING FOR SPINDLES OF SPINNING OR TWISTING MACHINES

[75] Inventors: Hans Braxmeier; Hans Stahlecker, both of Süssen, Fed. Rep. of Germany

[73] Assignees: Fritz Stahlecker; Hans Stahlecker, both of Fed. Rep. of Germany

[21] Appl. No.: 440,332

[22] Filed: Nov. 22, 1989

Related U.S. Application Data

[63] Continuation-in-part of Ser. No. 365,716, Jun. 14, 1989.

[30] Foreign Application Priority Data

Nov. 26, 1988 [DE] Fed. Rep. of Germany ..... 3839942

[51] Int. Cl.[5] ..... F16C 35/10; D01H 7/12

[52] U.S. Cl. ..... 384/227; 57/135; 384/603

[58] Field of Search ..... 384/226, 227, 230, 238, 384/239, 548, 558, 564, 603; 57/134, 135

[56] References Cited

U.S. PATENT DOCUMENTS

| | | | |
|---|---|---|---|
| 1,631,736 | 6/1927 | Kirner | 384/603 |
| 2,251,390 | 8/1941 | Beede | 384/230 |
| 2,486,730 | 11/1949 | Berg | 57/135 |
| 2,631,070 | 3/1953 | Pitner | 384/603 |

FOREIGN PATENT DOCUMENTS

| | | | |
|---|---|---|---|
| 100735 | 3/1962 | Netherlands | 384/603 |

*Primary Examiner*—Thomas R. Hannon

*Attorney, Agent, or Firm*—Evenson, Wands, Edwards, Lenahan & McKeown

[57] ABSTRACT

In the case of a bearing for spindles of spinning or twisting machines having a spindle bearing housing which contains a collar bearing and a step bearing for a spindle shaft which is provided with a driving wharve reaching over the collar bearing, it is provided that the collar bearing is a needle bearing, and that the driving wharve has an outside diameter of no more than 17 mm.

13 Claims, 2 Drawing Sheets

D
L
1
2
3
4
5
6
7
8
9
10
11
12
13
14
15

BEARING FOR SPINDLES OF SPINNING OR TWISTING MACHINES

This is a continuation-in-part application of application Ser. No. 365,716, filed June 14, 1989.

BACKGROUND AND SUMMARY OF THE INVENTION

The invention relates to a bearing for spindles of spinning or twisting machines having a spindle bearing housing which contains a collar bearing and a step bearing with a pivot bearing for a spindle shaft which is equipped with a driving wharve reaching over the collar bearing.

A bearing of the initially mentioned type is the object of the above-noted parent application Ser. No. 365,716, which in turn is based on German patent application No. P 38 20 327.8. This bearing is designed particularly for smaller spindles in order to produce the currently required cop lengths of from 180 mm to 250 mm in the case of a ring diameter of maximally approximately 50 mm. It is necessary that such spindles operate perfectly between 3,000 $min^{-1}$ and 25,000 $min^{-1}$. Because of the design according to the older application, it is possible to provide the spindle shaft in the area of the collar bearing with a diameter which amounts to no more than 7 mm. In connection with the collar bearing provided in the older application which is constructed as a roller bearing, it is possible to reduce the outside diameter of the driving wharve to 19 mm. By means of this bearing, the power requirement may be reduced.

An object of the invention to construct a bearing of the initially mentioned type in such a manner that the power requirement may be further reduced.

This object is achieved by means of the fact that the distance between the collar bearing and the pivot bearing is no more than 100 mm and the diameter of the spindle shaft in the area of the collar bearing is no more than 7 mm, that the collar bearing is a needle bearing, and that the driving wharve has an outside diameter of no more than 17 mm.

By means of the construction according to the invention, it is possible to reduce the outside diameter of the driving wharve by at least 2 mm so that, as a result, the speed of a driving belt can be reduced which is required for the high rotational speeds. The driving power required during the no-load running of the spindles may be approximately 11% to 12% lower. Relative to the spinning output, the energy savings therefore amount to approximately 2%. In view of the high energy costs, this is a considerable advantage.

As a further development of preferred embodiments of the invention, it is provided that the receiving device of the needle bearing contains an outer ring with a flanged disk which is joined in one piece. This permits very precise bearing characteristics. In order to permit swinging motions of the spindle shaft, it is provided in a further development of the invention that the outer ring of the needle bearing is provided with a running surface for the needles which is arched in axial sectional view. As a result it is possible that the spindle shaft can carry out swinging motions in the area of the step bearing which can be absorbed without any tilting by the needles in the area of the collar bearing.

In a further development of preferred embodiments of the invention, it is provided that the collar bearing is held in a head bearing sleeve which, in proximity of the collar bearing, is connected with a centering tube whose end inserted into the head bearing sleeve is widened by means of plastic deformation before it is inserted. A centering sleeve which is widened or "flared" in this manner, can be fastened securely in the head bearing sleeve without the occurrence of excessive forces in axial direction during the mounting. For the same purpose, it is advantageous for the head bearing sleeve, in a further development, to have an interior surface, which tapers in the direction of the step bearing, in the section in which the head bearing sleeve is connected with the centering sleeve. In the case of the larger spindles which correspondingly have larger dimensions, no limitations were known of forces occurring during the mounting.

Other objects, advantages and novel features of the present invention will become apparent from the following detailed description of the invention when considered in conjunction with the accompanying drawings.

DETAILED DESCRIPTION OF THE DRAWINGS

Figure 1:
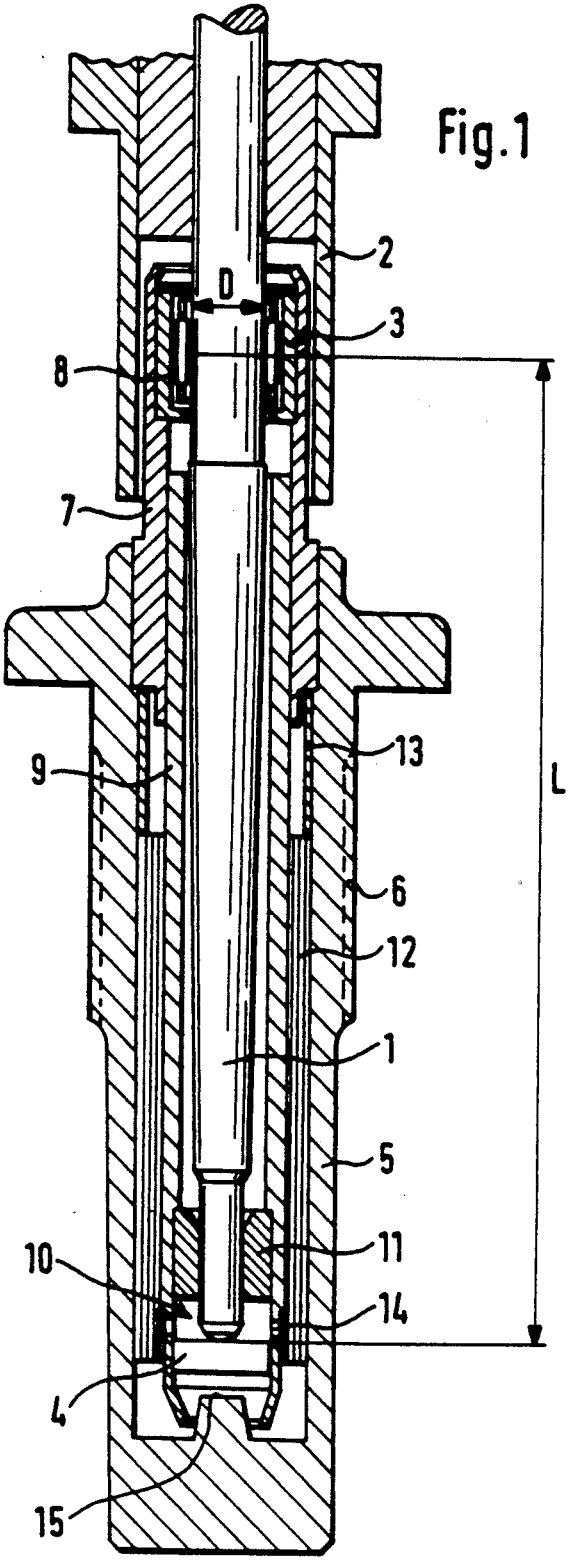
FIG. 1 is an axial sectional view of a bearing constructed according to a preferred embodiment of the invention in which the scale is enlarged in comparison to its real size.

FIG. 1 shows only the vertically aligned spindle shaft 1 of a ring spindle. In its upper, not shown area, this spindle shaft 1 is used as a receiving device for a spinning cop or a corresponding sleeve onto which a spinning cop is wound.

By means of a collar bearing 3 and a step bearing 10, the spindle shaft 1 is disposed in a bearing housing 5 which is equipped with a flange and an external thread 6 and is fastened to a spindle rail. At the spindle shaft 1, a driving wharve 2 is non-rotatably mounted which reaches around the collar bearing 3. The driving of the spindle takes place by means of a belt, particularly a tangential belt, moving along against this driving wharve 2.

In order to keep the belt speed of the driving belt, particularly of a tangential belt, as low as possible, and still achieve rotational speeds of 25,000 $min^{-1}$ or more, it is endeavored to keep the outside diameter of the driving wharve 2 as small as possible. By means of the measures according to the invention described below, it is possible to limit this outside diameter to maximally 17 mm.

The outside diameter of the driving wharve 2 depends essentially on the diameter (D) of the spindle shaft in the area of the collar bearing 3 and on the outside diameter of the bearing ring of the collar bearing 3. It is therefore provided that the diameter (D) of the spindle shaft 1 amounts to maximally 7 mm, and that, in addition, the collar bearing 3 is constructed as a needle bearing. Needle bearings of this type are known on the basis of German Industrial Standards Nos. DIN 617 and 618. In order to, on the one hand, keep the masses of the rotating parts as small as possible and, on the other hand, not make the spindle shaft 1, which tapers in the direction of the step bearing 10, too elastically bendable, the length (L) between the collar bearing 3 and a pivot bearing 4 of the step bearing 10, which is developed as a pivot disk, is limited to maximally 100 mm.

In the spindle bearing housing 5, a head bearing sleeve 7 is held by means of a press fit and forms a bearing receiving device 8 for the collar bearing 3 constructed as a needle bearing. Following in the direction toward the step bearing 10, a centering sleeve 9 is mounted at the head bearing sleeve 7 in proximity of the collar bearing 3. The centering sleeve 9 has an essentially cylindrical outer contour. In a manner, which is not shown in detail, it is provided with offset incisions or with one spiral-shaped incision in the area behind the head bearing sleeve 7.

The end of the centering sleeve 9 facing away from the head bearing sleeve 7 accommodates the step bearing 10 The step bearing 10 contains the already mentioned disk-shaped pivot bearing 4 which is held in the centering sleeve 9 by means of a press fit. The end of the spindle shaft 1 supports itself in axial direction against this pivot bearing 4. At an axial distance from the pivot bearing 4, the centering sleeve 9 also carries a step bearing sleeve 11 which is also held by means of a press fit. With respect to the offset cylindrical end section of the spindle shaft 1, this step bearing sleeve 11 has a bearing clearance of from 0.008 mm to 0.01 mm.

On the outside, the centering sleeve 9 is surrounded by a damping spiral 12 which is positioned by means of a spacing sleeve 13 arranged between the head bearing sleeve 7 and the end of the damping spiral 12 facing away from the step bearing 10. The damping spiral 12 is located in an oil bath. In the area of the step bearing 10, the centering sleeve 9 is provided with cross holes 14 so that an oil lubrication is obtained in the area of the step bearing sleeve 11 and of the pivot bearing.

The bottom of the spindle bearing housing 5 is provided with a centric projection 15 which, as a stop surface, is situated opposite the pivot bearing 4. In the case of above-average axial loads which result in an elastic longitudinal expansion of the centering sleeve 9, the axial movement is limited by this stop surface.

The bearing receiving device 8 for the collar bearing 3 constructed as a needle bearing contains an outer bearing ring 16 which is provided in one piece with a flanged disk 17 located on the side facing the step bearing 10. In upward direction, the needle bearing is shielded by means of a sealing ring whose outside diameter corresponds approximately to the outside diameter of the outer ring 16. The outer ring 16 sits on a radial projection of the head bearing sleeve 7 (see also FIG. 5—head bearing sleeve 7' and projection 22'). It is secured in this position by a beading of the upper edge of the head bearing sleeve 7.

Figure 2:
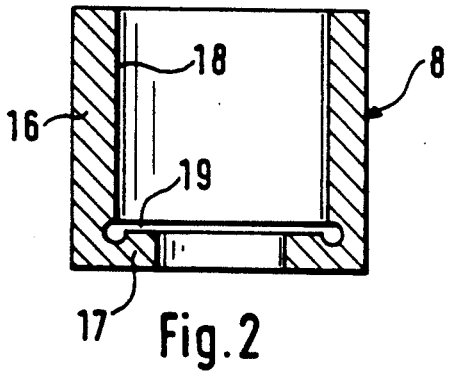
FIG. 2 is a further enlarged partial sectional view of a detail of the embodiment of FIG. 1.
Figure 3:
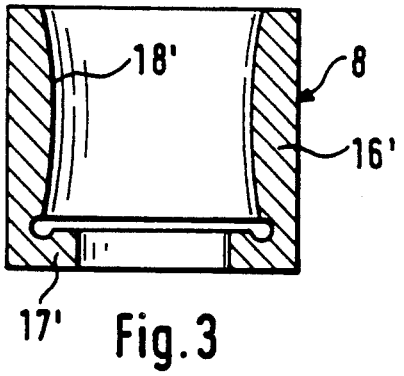
FIG. 3 is a partial sectional view of a detail similar to FIG. 2.

The outer bearing ring 16 according to FIG. 2 has a ground circumferential surface 18 and also a ground radial surface 19 of the flanged disk 17 which are separated by a groove. In order to permit slight swinging motions in the area of the collar bearing 3 constructed as a needle bearing, it is provided according to FIG. 3 that the inner circumferential surface 18' of the outer ring 16', in axial sectional view, is slightly spherically arched so that the needles can carry out a slight swinging motion with the spindle shaft 1.

Figure 4:
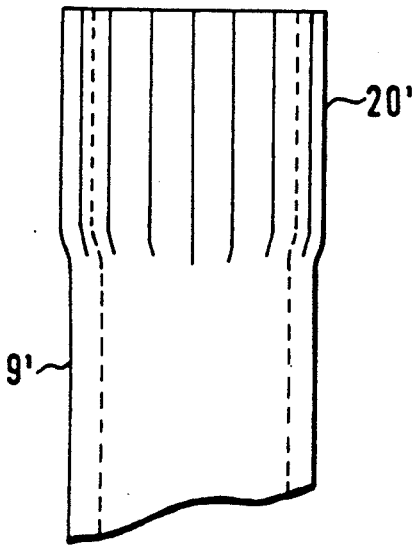
FIG. 4 is a partial view of an also enlarged centering sleeve.
Figure 5:
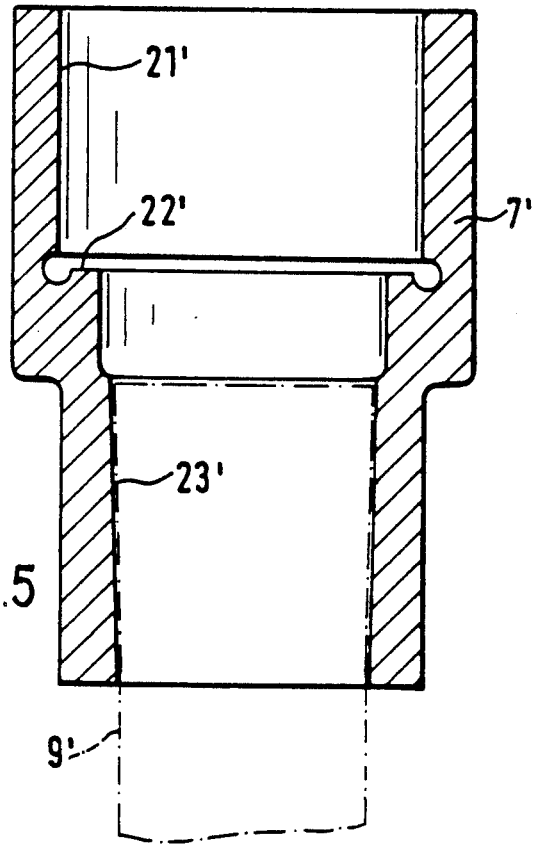
FIG. 5 is an axial partial sectional view of a head bearing sleeve used for receiving the centering sleeve according to FIG. 4.

In order to hold the centering sleeve 9 in the head bearing sleeve 7 by means of a press fit, if possible, without any high axial forces and, nevertheless, provide an initially cylindrical centering sleeve 9, measures are taken according to the embodiment of FIGS. 4 and 5. The centering sleeve 9' is widened by means of plastic deformation in the end area 20' to be connected with the head bearing sleeve 7'. A tool equipped with axial ribs is used for this purpose so that a "flaring" is obtained. By means of this area 20', which is widened by the plastic deformation, the centering sleeve 9' is fastened in section 23' of the head bearing sleeve 7' which tapers in the direction of the step bearing 10. In this manner, a very firm connection may be achieved between the centering sleeve 9' and the head bearing sleeve 7', without the application of excessive axial forces.

On the basis of the dimensions resulting from the construction according to the invention, it is possible to reduce the driving power for each spindle by approximately 10 watts.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A bearing for spindles of spinning or twisting machines having a spindle bearing housing which contains a collar bearing and a step bearing with a pivot bearing for a spindle shaft which is equipped with a driving wharve reaching over the collar bearing, wherein the distance between the collar bearing and the pivot bearing amounts to no more than 100 mm, and the diameter (D) of the spindle shaft 1 in the area of the collar bearing amounts to no more than 7 mm, wherein the collar bearing is a needle bearing, and wherein the driving wharve has an outside diameter of no more than 17 mm to thereby facilitate high rotational driving speeds of the spindle shaft with minimum belt speeds engaging the driving wharve.

2. A bearing according to claim 1, wherein a bearing receiving device of the needle bearing contains an outer ring with a flanged disk which is joined in one piece.

3. A bearing according to claim 2, wherein the collar bearing is held in a head bearing sleeve which, in proximity of the collar bearing, is connected with a centering pipe whose end inserted into the head bearing sleeve is widened by means of plastic deformation before the insertion.

4. A bearing according to claim 3, wherein the head bearing sleeve has an interior surface which tapers in the direction of the step bearing in the section in which it is connected with the centering sleeve.

5. A bearing according to claim 2, wherein the outer ring of the needle bearing is provided with a running surface for the needles which is arched in axial sectional view.

6. A bearing according to claim 5, wherein the collar bearing is held in a head bearing sleeve which, in proximity of the collar bearing, is connected with a centering pipe whose end inserted into the head bearing sleeve is widened by means of plastic deformation before the insertion.

7. A bearing according to claim 6, wherein the head bearing sleeve has an interior surface which tapers in the direction of the step bearing in the section in which it is connected with the centering sleeve.

8. A bearing according to claim 1, wherein the collar bearing is held in a head bearing sleeve which, in proximity of the collar bearing, is connected with a centering pipe whose end inserted into the head bearing sleeve is widened by means of plastic deformation before the insertion.

9. A bearing according to claim 8, wherein the head bearing sleeve has an interior surface which tapers in the direction of the step bearing in the section in which it is connected with the centering sleeve.

10. A bearing according to claim 1, wherein the outside diameter of the driving wharve is no larger than the outside diameter of cylindrical portions of said bearing housing which are to be inserted in a support rail.

11. A bearing for spindles of spinning or twisting machines having a spindle bearing housing which contains a collar bearing and a step bearing with a pivot bearing for a spindle shaft which is equipped with a driving wharve reaching over the collar bearing, wherein the distance between the collar bearing and the pivot bearing amounts to no more than 100 mm, and the diameter (D) of the spindle shaft 1 in the area of the collar bearing amounts to no more than 7 mm, wherein the collar bearing is a needle bearing, and wherein the driving wharve has an outside diameter of no more than 17 mm, wherein a bearing receiving device of the needle bearing contains an outer ring with a flanged disk which is joined in one piece, and wherein the outer ring of the needle bearing is provided with a running surface for the needles which is arched in axial sectional view.

12. A bearing according to claim 11, wherein the collar bearing is held in a head bearing sleeve which, in proximity of the collar bearing, is connected with a centering pipe whose end inserted into the head bearing sleeve is widened by means of plastic deformation before the insertion.

13. A bearing according to claim 12, wherein the head bearing sleeve has an interior surface which tapers in the direction of the step bearing in the section in which it is connected with the centering sleeve.

* * * * *